US008719972B1

(12) United States Patent
Baker et al.

(10) Patent No.: US 8,719,972 B1
(45) Date of Patent: May 13, 2014

(54) URINE ABSORPTION PAD SYSTEM FOR A TOILET

(76) Inventors: Carla Baker, Sioux Falls, SD (US); Scott Baker, Sioux Falls, SD (US)

( * ) Notice: Subject to any disclaimer, the term of this patent is extended or adjusted under 35 U.S.C. 154(b) by 1131 days.

(21) Appl. No.: 12/701,740

(22) Filed: Feb. 8, 2010

(51) Int. Cl.
*E03D 9/00* (2006.01)
*A47K 17/00* (2006.01)

(52) U.S. Cl.
CPC ... *A47K 17/00* (2013.01); *Y10S 4/05* (2013.01)
USPC ..... 4/300.3; 4/DIG. 5

(58) Field of Classification Search
CPC ..... A47K 17/00
USPC ..... 4/300.3, 661, 420.4, 445, 448, DIG. 5; D23/310
See application file for complete search history.

(56) References Cited

U.S. PATENT DOCUMENTS 2,839,764 A 6/1958 Gardner
3,995,325 A * 12/1976 Baffico ..... 4/DIG. 5
4,215,443 A * 8/1980 Babik ..... 4/300.3
4,348,776 A 9/1982 Sarjeant
4,912,784 A 4/1990 Jacobson
5,732,416 A 3/1998 Albert
5,983,410 A 11/1999 Webster
6,305,034 B1 10/2001 Urrutia
6,357,055 B1 3/2002 Gambla
6,385,785 B1 5/2002 Linden
6,458,112 B1 * 10/2002 Marshall et al. ..... 604/385.04
6,550,075 B1 4/2003 Brannon
6,667,424 B1 * 12/2003 Hamilton et al. ..... 604/375
D523,127 S 6/2006 Sublett
D571,902 S 6/2008 Carson

* cited by examiner

*Primary Examiner* — Tuan N Nguyen
(74) *Attorney, Agent, or Firm* — Jeffrey A. Proehl; Woods, Fuller, Shultz & Smith, P.C.

(57) ABSTRACT

A urine absorption system may comprise a toilet including a bowl having a rim portion with an upper surface. A toilet seat assembly may be mounted on the bowl of the toilet, the seat assembly including a pair of hinge posts mounted on the rim of the bowl. The system includes a urine absorption pad for absorbing stray urine on the upper surface of the rim of the toilet bowl. The absorption pad may be positioned on the upper surface of the rim portion of the bowl, and at least a portion of the absorption pad may be positioned between the pair of hinge posts of the toilet seat assembly.

1 Claim, 3 Drawing Sheets

URINE ABSORPTION PAD SYSTEM FOR A TOILET

BACKGROUND

1. Field

The present disclosure relates to devices for handling urine overspray on a toilet and more particularly pertains to a new urine absorption pad system for a toilet for collecting stray urine drops on the toilet bowl rim in an article that is easily mountable in position on the toilet and then removable and disposable after a period of time.

2. Description of the Prior Art

Urine overspray on surfaces of a toilet is a recognized problem, and numerous apparatus and articles have been proposed to help alleviate this problem by attempting to redirect the errant drops into the bowl of the toilet. Such devices tend to be more complicated than necessary, and of course need to periodically be cleaned themselves lest they become a sanitary concern themselves.

SUMMARY

In view of the foregoing, the present disclosure describes a new urine absorption pad system for a toilet which may be utilized for collecting stray urine drops on the toilet bowl rim in an article that is easily mountable in position on the toilet and then removable and disposable after a period of time.

In one aspect, the present disclosure relates to a urine absorption system comprising a toilet including a bowl with a front and a rear, and a rim portion that defines an opening and has an upper surface. A toilet seat assembly may be mounted on the bowl of the toilet, and the seat assembly may include a pair of hinge posts mounted on the rim of the bowl. The system may include a urine absorption pad for absorbing stray urine on the upper surface of the rim of the toilet bowl. The absorption pad may be positioned on the upper surface of the rim portion of the bowl, and at least a portion of the absorption pad may be positioned between the pair of hinge posts of the toilet seat assembly.

In another aspect, the disclosure relates to a urine absorption pad for positioning on an upper surface of a bowl of a toilet to absorb stray urine on the upper surface of the rim of the toilet bowl. The pad may comprise a major portion and a minor portion. The major portion may have a shape that is elongated in a first direction and has opposite ends. The major portion may have a length measured in the first direction. The minor portion may extend away from one side of the major portion. The minor portion may include a necked section located adjacent to the major portion for positioning between a pair of hinge posts of a toilet seat assembly. The necked section may have a width dimension measured in the first direction. The minor portion may include a flare section located adjacent to the necked section and located on an opposite side of the necked section from the major portion. The flare section may have a width dimension measured in the first direction. The width of the necked section may be less than the width of the flare section.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
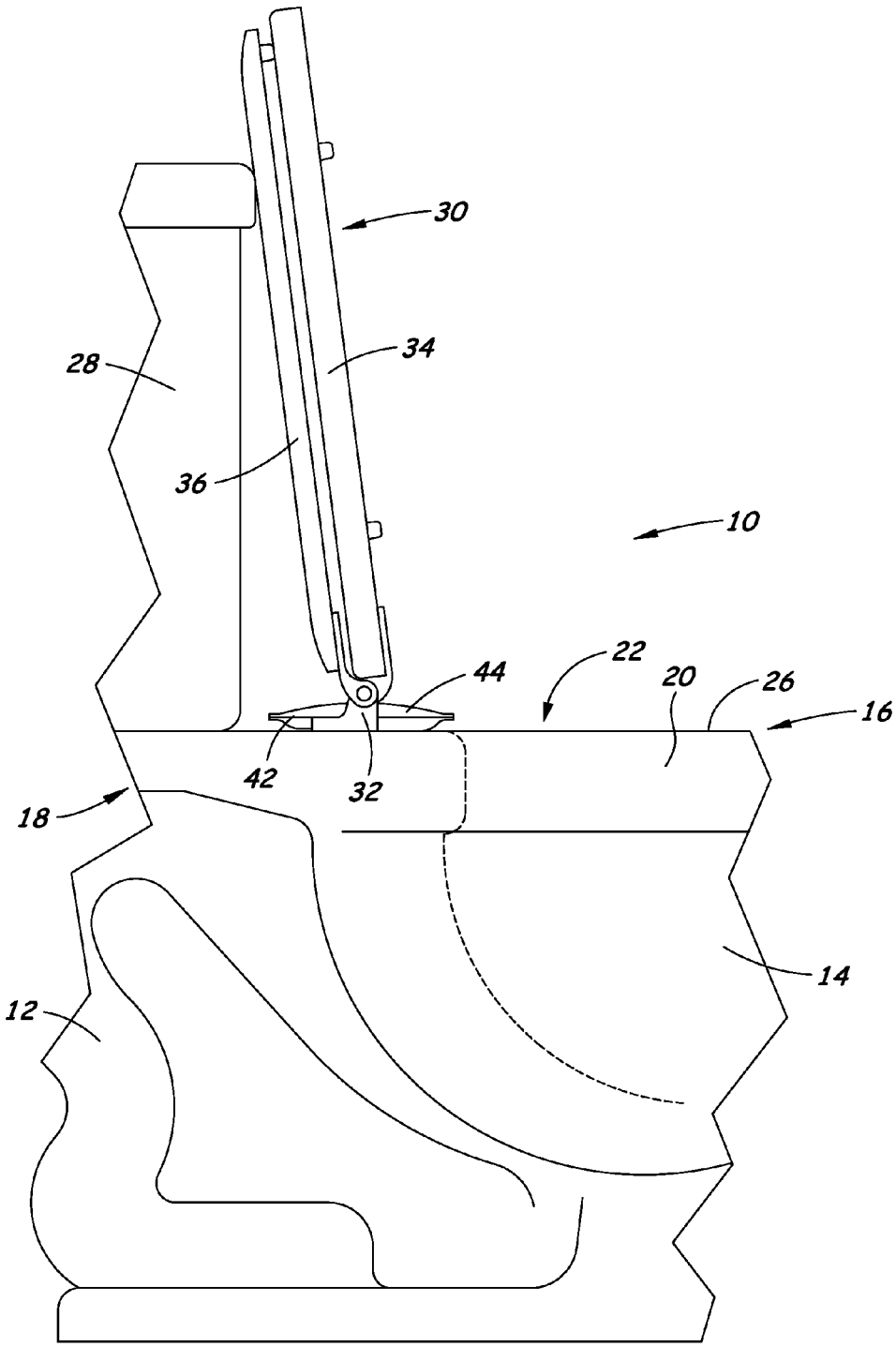
FIG. 1 is a schematic side view of a new urine absorption pad system for a toilet according to the present disclosure.
Figure 2:
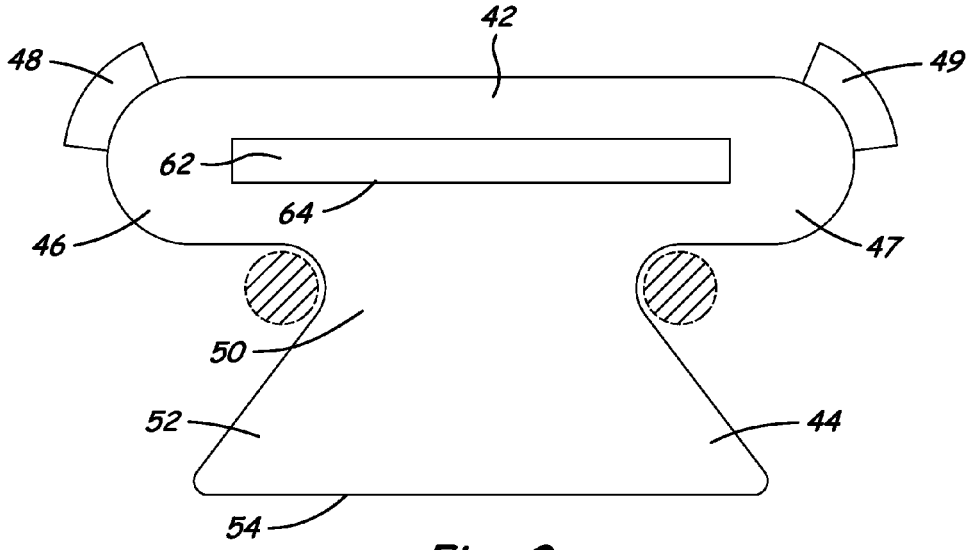
FIG. 2 is a schematic bottom view of the urine absorption pad, according to an illustrative embodiment.
Figure 3:
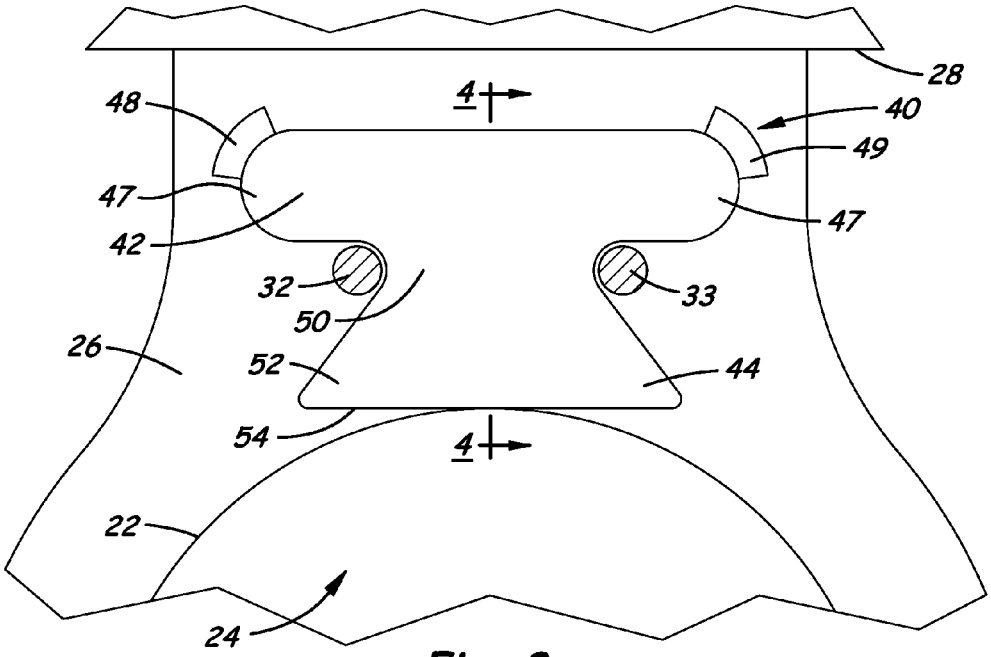
FIG. 3 is a schematic top view of the urine absorption pad mounted on the upper surface of the bowl of a toilet, according to an illustrative embodiment.
Figure 4:
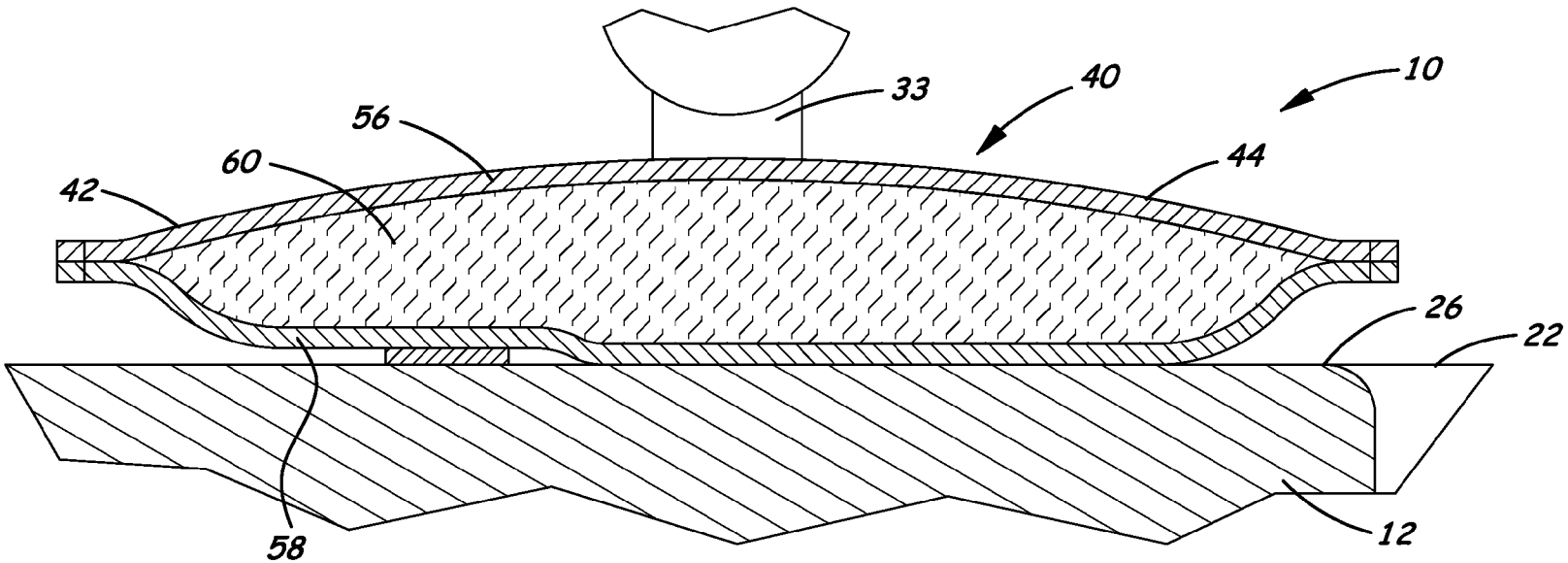
FIG. 4 is a schematic side sectional view of a portion of the system, according to an illustrative embodiment.

With reference now to the drawings, and in particular to FIGS. 1 through 4 thereof, a new urine absorption pad system for a toilet embodying the principles and concepts of the disclosed subject matter will be described.

This disclosure relates to a urine absorption system 10 for collecting stray urine drops that would otherwise land on the toilet bowl rim, as well as drops that do land on the toilet bowl rim and would otherwise soil the upper surface of the rim and even run down the side of the toilet or that do. This disclosure describes an article that is easily mountable in an effective position on the toilet and is then removable and disposable after a period of time of use on the toilet.

In a broader sense, the urine absorption system 10 may comprise a toilet 12 that includes a bowl 14 with a front 16 and a rear 18. The bowl has a rim portion 20 that defines an opening 22 into an interior 24 of the bowl. The rim portion 20 of the bowl has an upper surface 26 that extends outwardly from the opening 22. The toilet 12 may also include a tank 28 that may be positioned above the rear 18 of the bowl 14.

The system 10 may include a toilet seat assembly 30 that is mounted on the bowl 14 of the toilet 12. The seat assembly 30 may include a pair of hinge posts 32, 33 mounted on the rim portion 20 of the bowl that support the hinge and the rest of the seat assembly in a spaced condition about the upper surface to thereby create a gap between the upper surface and the parts of the seat assembly. The pair of hinge posts 32, 33 may be spaced from each other on the rim portion, and typically the hinge posts extend upwardly from the upper surface 26 of the rim portion. The toilet seat assembly 30 may also include a seat ring 34 pivotally mounted on the pair of hinges 32, 33, as well as a seat cover 36 which is also pivotally mounted on the pair of hinges.

A significant element of the disclosure, and the system 10, is a urine absorption pad 40 for absorbing stray urine drops that land, or would otherwise land, on the upper surface of the rim portion of the toilet bowl. The absorption pad 40 is positionable on the upper surface 26, and may be positioned between the pair of hinges 32, 33. The absorption pad 40 may rest on a portion of the upper surface 26 that is located between the opening 22 of the bowl and the rear 18 of the bowl, and thus may be positioned between the opening and the location on the upper surface where the tank 28 rests in many types of toilets although this positioning is not critical to the invention.

The absorption pad 40 has a perimeter that may be characterized as a major section or portion 42 and a minor section or portion 44. The major portion 42 is generally larger in area than the minor portion 44, although this relationship is not critical to the function of the pad. The major portion 42 may be positionable between the pair of hinges 32, 33 of the toilet seat assembly and the rear 18 of the bowl. The minor portion 44 may be positioned between the major portion 42 and the opening 22 of the bowl 14.

In greater detail, the major portion 42 of the pad perimeter may have an elongated oval shape with opposite ends 46, 47. The major portion 42 may also have a pair of tabs 48, 49 for providing points or locations on the pad 40 for the user to grasp the pad for lifting the pad away from the upper surface 26 of the bowl to facilitate removal of the pad from the upper surface. Each of the tabs 48, 49 may extend from the respective ends 46, 47 of the major portion 42 such that the tabs extend in substantially opposite directions. The tabs 48, 49 may generally extend in directions away from the minor portion 44.

The minor portion 44 of the absorption pad 40 may extend away from one side of the major portion between the ends 46, 47 of the major portion, and may extend from a substantially central location on the side of the major portion. The portion of the perimeter of the pad on the minor portion may have a generally bell-shaped configuration. The minor portion 44 may include a necked section 50 that is located adjacent to the major portion 42 and is adapted for positioning between the pair of hinges 32, 33 of the toilet seat assembly 30. The width of the pad 40 at the necked section 50 should be approximately equal to, or less than, the distance between the hinges 32, 33, while the major portion of the pad, and other sections of the minor portion may have widths that are greater than the distance between the hinges. This configuration can serve to hold the pad in position on the upper surface with respect to the hinges and the toilet seat assembly cne portion. The minor portion 44 may also include a flare section 52 that may be located adjacent to the necked section 50 and may be located on an opposite side of the necked section from the major portion. The flare section 52 may taper wider towards a side of the minor portion that is located furthest from the major portion for positioning the wider section relatively closer to the opening 22 of the bowl than the major portion 42. The flare section 52 may terminate in a substantially linear edge 54 that is located on the minor portion at a location opposite of the major portion 42.

The absorbent pad 40 may comprise an upper layer 56 for orienting in an upward direction when the pad 40 is mounted on the toilet bowl for use. The upper layer 56 may be formed of a substantially fluid permeable material for allowing urine or other liquids to pass through the upper layer to an interior of the pad. The pad 40 may also include a lower layer 58 for orienting in a downward direction when the pad 40 is mounted on the toilet bowl for use. The lower layer 58 may also be formed of a substantially fluid permeable material for allowing liquids to pass through the layer.

The absorbent pad 40 may also include an absorbent layer 60 which may be positioned in an interior of the pad, such as between the upper 56 and lower 58 layers of the pad. The absorbent layer 60 may comprises a substantially fluid absorbent material that is capable of absorbing fluids such as urine that pass through the upper or lower layers. An odor neutralizing substance for neutralizing odor associated with urine contacting the pad may be included in the pad, and may be located in the absorbent layer 60.

The pad may also include at least one area of adhesive 62 applied on an outer surface of the lower layer 58 of the pad for removably attaching the pad 40 to the upper surface 26 of the rim portion of the toilet bowl. The area of adhesive 62 may comprise a pressure-sensitive adhesive which may be configured to form a bond with the upper surface 26 that is not strong enough to tear the pad 40 when a user pulls the pad away from the upper surface using one or both of the tabs 48, 49 of the major portion 42. The adhesive 62 may be located on the major portion 42, or may be located on the minor portion, or may be located on both portions. The adhesive 62 may be positioned in at least one strip 64 that is located on the outer surface of the lower layer, and the strip may extend in a direction that is parallel to the longitudinal direction of the major portion. A protective liner strip of material with a release material on its surface may be applied to the area of adhesive 62 prior to use, and may be peeled away from the adhesive just prior to application of the adhesive to the upper surface 26 of the rim portion.

In use, any protective material may be removed from the adhesive so as to expose the adhesive. The user may close the toilet seat assembly 30 such that the opening 22 is covered by the seat ring and seat cover, and the minor portion of the pad may be inserted forwardly through the gap between the hinges 32, 33 and toward the opening, such that the major portion remains on the rearward side of a line that extends through both of the hinges, and the minor portion is substantially bisected by the same line while a section of the minor portion is positioned on a forward side of the line. Alternatively, the seat ring and seat cover of the seat assembly may be placed in an open condition, and the major portion of the pad may be moved rearwardly between the hinges such that the major portion ends up on the rear side of the line that extends through the hinges. As the major portion may be significantly larger than the minor portion in many embodiments of the pad, this alternative manner of mounting may be more difficult.

Once the pad is in position, force may be applied to the pad to provide firm contact between the adhesive and the upper surface of the rim to hold the pad in position.

It will be noted that the pad 40, when mounted on the toilet 12, may be substantially free of connection to the seat ring 34 and the seat cover 36 of the toilet seat assembly 30, and thus the effectiveness of the pad is not dependent upon the position of the seat ring or seat cover.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. A urine absorption pad for positioning on an upper surface of a bowl of a toilet to absorb stray urine on the upper surface of the rim of the toilet bowl, the toilet being of the type with a rim portion defining an opening and having a front and a rear, and a pair of hinge posts mounted on the rim of the bowl, the pad including:

a middle section of the absorption pad for positioning between the pair of hinge posts of the toilet seat assembly;

a forward section of the absorption pad extending in a forward direction from the middle section for extending from between the hinge posts toward the opening of the bowl;

a rearward section of the absorption pad extending from the middle section in a rearward direction opposite of the forward direction for extending away from the opening of the bowl;

wherein the forward section extends continuously from the middle section and the rearward section extends continuously from the middle section to provide continuous coverage of the upper surface from locations forward of the hinge posts to rearward of the hinge posts; and wherein a pair of notches is formed in the pad, the notches being located at opposite ends of the middle section of the pad and opening up in opposite directions for receiving the hinge posts, the middle section of the pad extending continuously from a first one of the notches to a second one of the notches;

wherein a lateral width of the middle section positioned the pair of notches is relatively shorter than a maximum lateral width of the forward section and a maximum lateral width of the rearward section for resisting movement of the pad from between the posts;

wherein the absorption pad includes a major portion and a minor portion, the major portion being configured to cover a relatively larger area of the upper surface of the bowl and the minor portion being configured to cover a relatively smaller area of the upper surface of the bowl;

wherein the forward section includes a flare section tapering narrower toward the middle section and wider away from the middle section;

wherein at least one tab extends from the rearward section for providing a location on the pad for a user to grasp the pad for lifting the pad away from the upper surface of a toilet bowl;

at least one area of adhesive applied on a lower surface of the pad for removably attaching the pad to the upper surface of the rim of the toilet bowl;

wherein the pad comprises:

an upper layer for orienting upwardly when the pad is mounted on the toilet bowl for use;

a lower layer for orienting downwardly when the pad is mounted on the toilet bowl for use; and an absorbent layer which covers an absorbent material that is positioned inside of the pad, the absorbent layer comprising a substantially fluid absorbent material;

wherein the upper and lower layers are formed of a substantially fluid permeable material; and wherein the pad comprises an odor neutralizing substance for neutralizing odor associated with urine contacting the pad.

* * * * *